US009249773B2

(12) United States Patent
Cunningham et al.

(10) Patent No.: US 9,249,773 B2
(45) Date of Patent: Feb. 2, 2016

(54) APPARATUS AND METHOD FOR STATIC TESTING A SPARK PLUG ASSEMBLED IN AN INTERNAL COMBUSTION ENGINE INCLUDING CRACKED CERAMIC INSULATOR DETECTION

(71) Applicants: GM GLOBAL TECHNOLOGY OPERATIONS LLC, Detroit, MI (US); Bauer Associates, Inc., Plymouth, MI (US)

(72) Inventors: Thomas M. Cunningham, Novi, MI (US); Harold M. Ryan, Pinckney, MI (US)

(73) Assignees: GM Global Technology Operations LLC, Detroit, MI (US); Bauer Associates, Inc., Plymouth, MI (US)

( * ) Notice: Subject to any disclaimer, the term of this patent is extended or adjusted under 35 U.S.C. 154(b) by 574 days.

(21) Appl. No.: 13/658,252

(22) Filed: Oct. 23, 2012

(65) Prior Publication Data

US 2014/0111213 A1 Apr. 24, 2014

(51) Int. Cl.

| | |
|---|---|
| ***F02P 17/00*** | (2006.01) |
| ***F02P 1/08*** | (2006.01) |
| ***H01T 13/05*** | (2006.01) |
| ***H01T 13/58*** | (2011.01) |
| *H01T 21/02* | (2006.01) |

(52) U.S. Cl.
CPC ..... *F02P 17/00* (2013.01); *H01T 13/58* (2013.01); *H01T 21/02* (2013.01)

(58) Field of Classification Search
CPC ..... F02P 17/00; F02P 1/08; H01T 13/05
See application file for complete search history.

(56) References Cited

U.S. PATENT DOCUMENTS

| | | | | |
|---|---|---|---|---|
| 4,291,383 | A * | 9/1981 | Tedeschi et al. | 324/384 |
| 4,825,167 | A * | 4/1989 | Bayba | 324/399 |
| 5,111,790 | A * | 5/1992 | Grandy | 324/380 |
| 5,136,240 | A * | 8/1992 | Geier et al. | 324/220 |
| 5,491,416 | A * | 2/1996 | Klimstra et al. | 324/393 |
| 6,604,410 | B2 * | 8/2003 | Varady et al. | 73/114.05 |
| 7,677,230 | B2 * | 3/2010 | Meyer et al. | 123/638 |
| 2002/0067110 | A1 * | 6/2002 | Nishikawa et al. | 313/118 |
| 2009/0160450 | A1 | 6/2009 | Stauner | |
| 2011/0175515 | A1 * | 7/2011 | Kameda et al. | 313/141 |
| 2014/0020667 | A1 * | 1/2014 | Ishiguro | 123/634 |

FOREIGN PATENT DOCUMENTS

| | | | |
|---|---|---|---|
| CN | 2208620 | Y | 9/1995 |
| CN | 101356363 | A | 1/2009 |
| JP | 1089226 | A | 4/1998 |
| JP | 2008057507 | A | 3/2008 |

* cited by examiner

*Primary Examiner* — Jermele M Hollington
(74) *Attorney, Agent, or Firm* — Quinn Law Group, PLLC

(57) ABSTRACT

An apparatus and method is provided for testing a spark plug after the spark plug is assembled in an internal combustion engine. The apparatus includes a high voltage test probe to mechanically probe the spark plug. The high voltage test probe includes a non-electrically conductive part, an electrically conductive ring substantially shielded by the non-electrically conductive part, and a high voltage contactor for electrically connecting to a terminal end of the spark plug. The apparatus also includes a high voltage control box having a high voltage source and an electrical ground, and including at least one of an insulator crack detection circuit and a spark plug firing circuit. The method includes using the apparatus to test assembled spark plugs.

16 Claims, 4 Drawing Sheets

FIG. 3
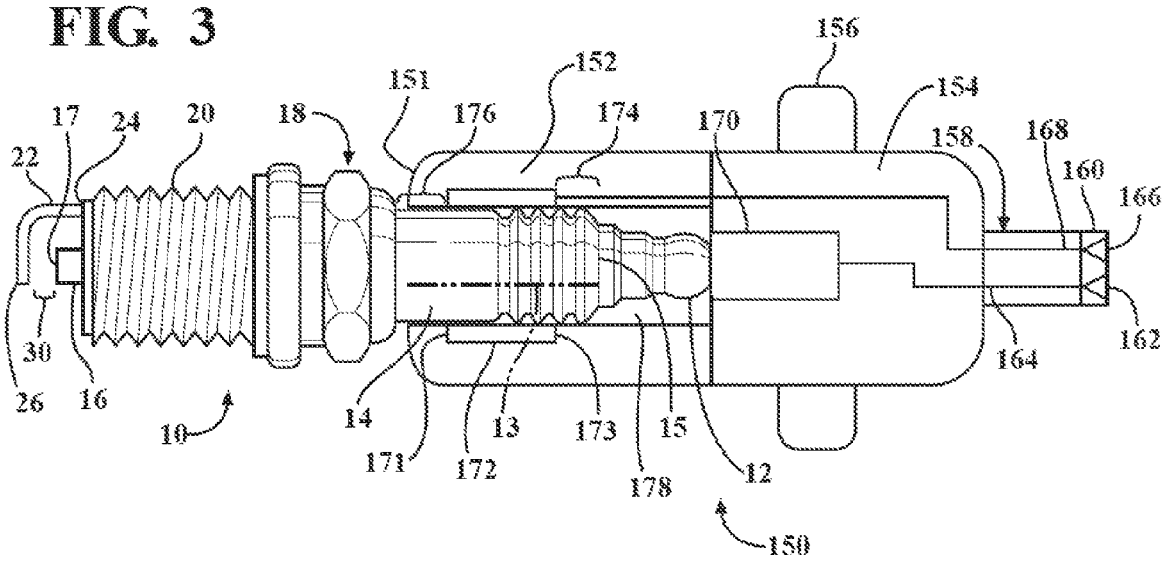
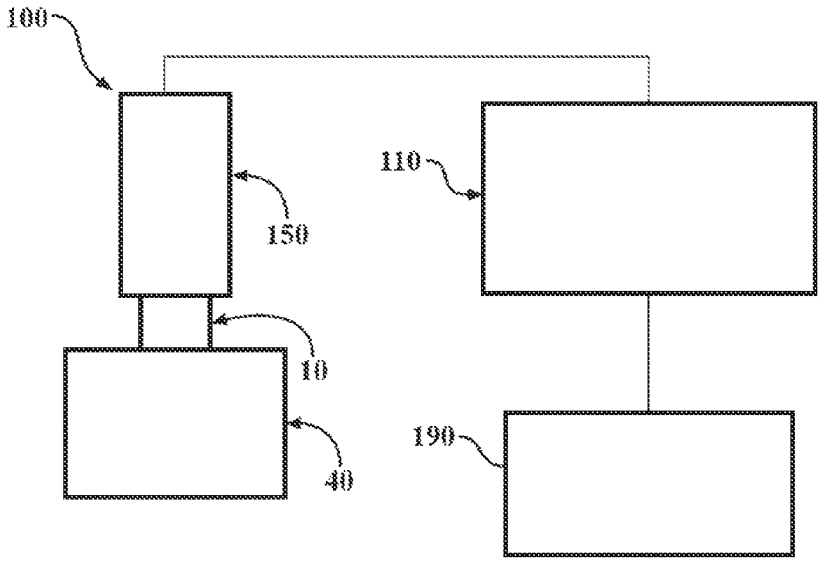
FIG. 4

APPARATUS AND METHOD FOR STATIC TESTING A SPARK PLUG ASSEMBLED IN AN INTERNAL COMBUSTION ENGINE INCLUDING CRACKED CERAMIC INSULATOR DETECTION

TECHNICAL FIELD

This invention relates to an apparatus and method for testing spark plugs and, more particularly, to detecting a cracked ceramic insulator of a spark plug, and indicating whether a spark plug gap is within specification, after assembly into an internal combustion engine.

BACKGROUND

Spark plugs are used in internal combustion engines to ignite an air/fuel mixture. The spark plug is generally mounted in the cylinder head of the engine so that the firing tip is in a combustion chamber. A conventional spark plug includes a ceramic body which serves as an insulator between a center electrode and an L-shaped side electrode. The L-shaped side electrode is attached to a metal shell crimped about the ceramic body. At the tip of the spark plug, the center electrode protrudes from the ceramic body and is spaced apart from the side electrode to form a spark plug gap. Once the spark plug has been assembled into the engine, it is desirable to test the spark plug. In a current spark plug tester, an ignition system may be fully assembled so that the ignition coil is connected (or an ignition coil may be connected in a test stand to simulate the ignition system). When the system fires, an electromagnetic field is created around the ignition coil. This electromagnetic field may be monitored or sensed by an inductive sensor placed adjacent the coil inside the electromagnetic field. Changes in the electromagnetic field indicate changes in the spark plug gap and possibly, infrequently, may indicate a crack in a ceramic insulator. In end of line cold test machines, testing for spark plug gaps and cracked ceramic insulators may be unreliable. This potential unreliability may allow spark plugs that are out-of-specification or have a cracked ceramic insulator to remain installed in an engine causing less than optimal engine performance.

SUMMARY

An apparatus and method for testing a spark plug after the spark plug is assembled in an internal combustion engine is provided. The apparatus includes a high voltage test probe to mechanically probe the spark plug. The high voltage test probe has a non-electrically conductive part, an electrically conductive ring substantially shielded by the non-electrically conductive part, and a high voltage contactor for electrically connecting to a terminal end of the spark plug. The apparatus also includes a high voltage control box having a high voltage source and an electrical ground, and including at least one of an insulator crack detection circuit for connecting the high voltage contactor to the electrical ground and the electrically conductive ring to the high voltage source to generate an insulator crack detection signal indicating if an insulator is cracked, and a spark plug firing circuit for connecting the high voltage contactor to the high voltage source to fire the spark plug in a firing test and to generate a spark plug firing signal indicating if the spark plug gap is within specification.

The method includes placing a high voltage test probe over substantially all of a spark plug extending from an internal combustion engine to mechanically probe the spark plug. The high voltage test probe has a non-electrically conductive part, an electrically conductive ring substantially shielded by the non-electrically conductive part, and a high voltage contactor for electrically connecting to the terminal end of the spark plug. The method also includes at least one of connecting the high voltage contactor and the electrically conductive ring to a high voltage control box so that an insulator crack detection circuit in the high voltage control box connects the high voltage contactor to an electrical ground and the electrically conductive ring to a high voltage source, and connecting the high voltage contactor to the high voltage control box so that a spark plug firing circuit in the high voltage control box connects the high voltage contactor to the high voltage source. The insulator crack detection circuit generates an insulator crack detection signal indicating if an insulator is cracked. The spark plug firing circuit fires the spark plug in a firing test and generates a spark plug firing signal indicating if the spark plug gap is within specification.

The above features and advantages and other features and advantages of the present invention are readily apparent from the following detailed description of the best modes for carrying out the invention when taken in connection with the accompanying drawings.

BRIEF DESCRIPTION OF THE DRAWINGS

FIG. 3 is a schematic side view illustration with the test probe of FIG. 2 placed over the spark plug for use in the apparatus of FIG. 1;

FIG. 4 is a block diagram of the apparatus and the spark plug being tested in accordance with the present invention.

DETAILED DESCRIPTION

Figure 1:
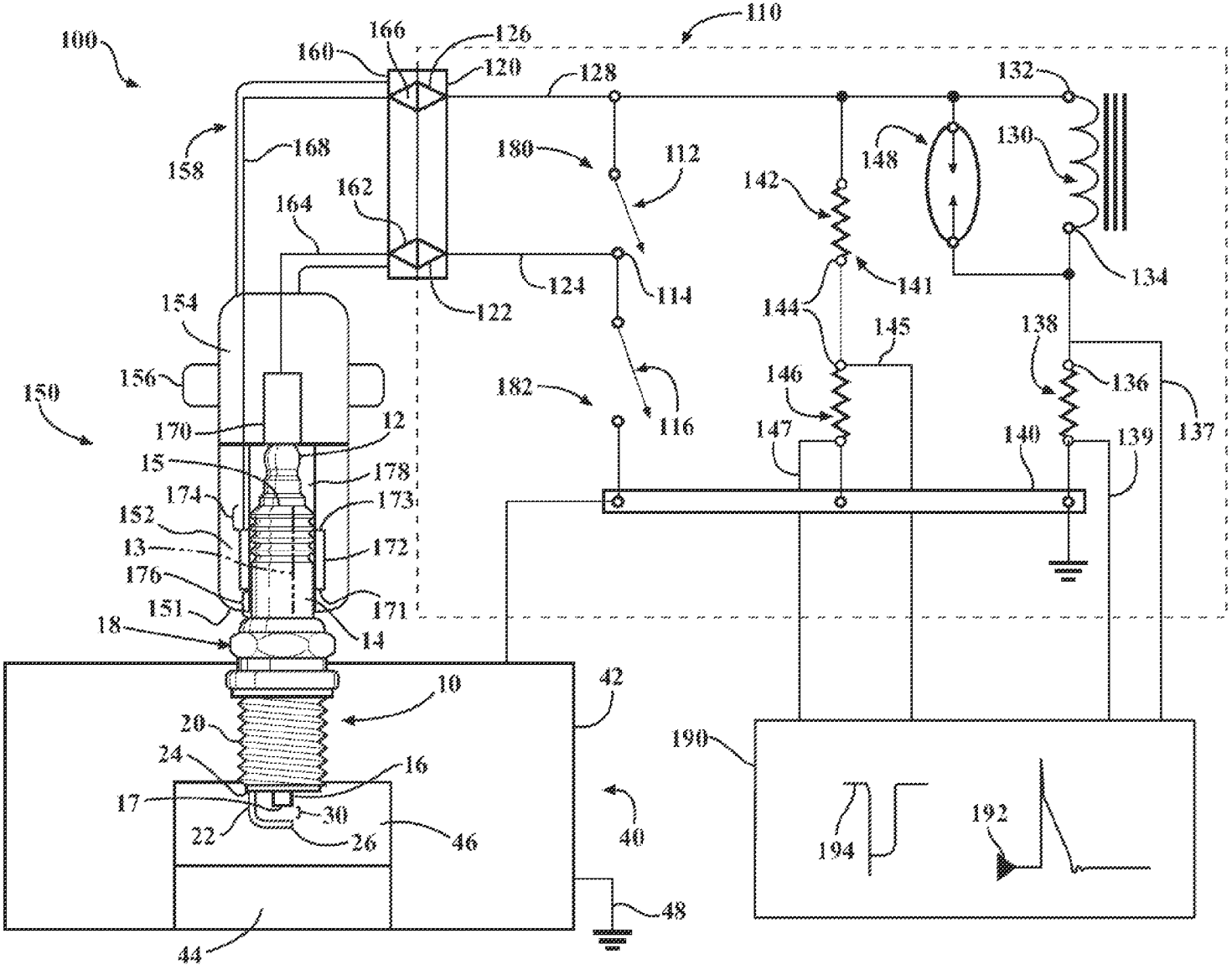
FIG. 1 is a schematic illustration of an apparatus of the present invention for testing a spark plug assembled in an internal combustion engine.

Referring to FIG. 1, the apparatus 100 of the present invention is provided in a schematic illustration. Throughout the Figures, internal parts are shown to aid in describing the invention. For clarity, the part to be tested (which is conventional) will be described first and then the apparatus 100 and the method 500 (shown in FIG. 5) of the present invention will be explained. As shown in FIG. 1, the part to be tested is a conventional spark plug 10 assembled in a conventional internal combustion engine 40. The spark plug 10 includes a stud terminator or terminal end 12 onto which the spark plug wire (not shown) of the internal combustion engine 40 connects.

Figure 2:
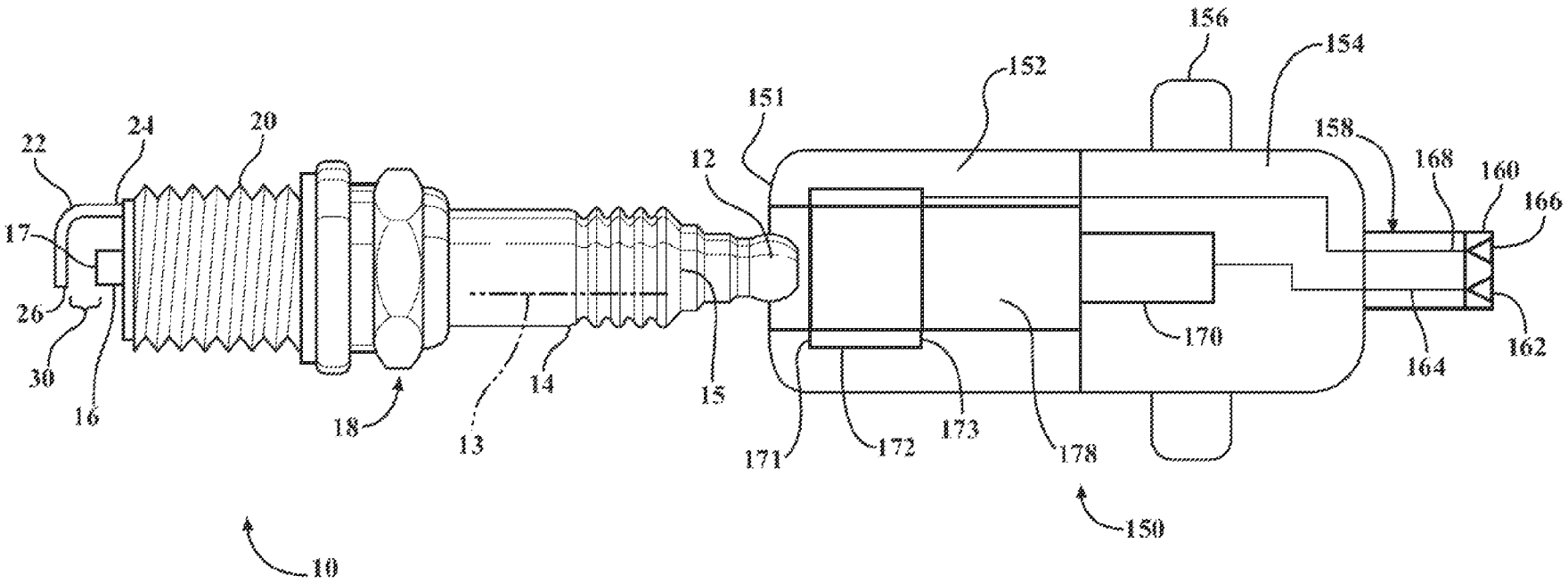
FIG. 2 is a schematic side view illustration of a spark plug and an embodiment of a test probe to mechanically probe the spark plug in accordance with the present invention.

Referring to FIGS. 1, 2 and 3, an insulator 14, which may be ceramic, surrounds a center electrode 16 having a first end 15 which is electrically connected to the stud terminal or terminal end 12 for receiving electrical power from the spark plug wire (in conventional use). The insulator 14 extends sufficiently along the length of the center electrode 16 to electrically isolate the center electrode 16 from other parts of the spark plug 10. As shown in phantom (dashed line) in FIG. 1, the insulator 14 may have a crack 13 which may cause it to perform less than optimally. The crack 13 may be substantially the entire length of the insulator 14 or may be a small, pin-hole sized crack and still be detected by the apparatus and method of the present invention. A base 18 typically having a hex head formed of a metal surrounds the insulator 14 providing a means of installing or assembling the spark plug 10 into the internal combustion engine 40. Also surrounding the insulator 14 is a metal shank 20 which threadably connects to a threaded opening in the cylinder head and block 42 of the internal combustion engine 40. The base 18 may be used for tightening the spark plug 10 into the cylinder head and block 42. The metal shank 20 electrically connects and grounds the spark plug 10 to the cylinder head and block 42 of the internal combustion engine 40 which is electrically grounded to a vehicle (not shown) ground 48. The metal shank 20 electrically connects to a side electrode 22 at a first end 24 of the side electrode 22. The second end 26 of the side electrode 22 extends into the combustion chamber 46 between a piston 44 and the cylinder head and block 42 of the internal combustion engine 40. As is known, a spark plug gap 30 is formed between the second end 26 of the side electrode 22 and a second end 17 of the center electrode 16. During operation of the internal combustion engine 40, an electrical potential applied to the center electrode 16 relative to the side electrode 22 (which is electrically grounded) generates a spark across the spark plug gap 30 to ignite a fuel-air mixture within the combustion chamber 46.

Referring to FIG. 4, a block diagram of the apparatus 100 and the part being tested, a spark plug 10, is shown. Blocks (having the reference numbers of the components shown in more detail in the other Figures) are used for clarity to show how the main components are connected for use with the present invention. The spark plug 10 is assembled in the internal combustion engine 40 for testing. The high voltage test probe 150 is placed over substantially all of the spark plug 10 extending from the internal combustion engine 40 to mechanically probe the spark plug 10. The high voltage test probe 150 is connected to the high voltage control box 110. The high voltage control box 110 is connected to a computer 190 (or other controller device) for testing and indicating whether the spark plug 10 passes each or any of the static tests as explained here-in-below.

Referring again to FIGS. 1, 2 and 3, the apparatus 100 enables at least one and up to three tests of the assembled spark plug to be performed using the high voltage control box 110 and the high voltage test probe 150. The high voltage test probe 150 surrounds a part of and electrically connects to the spark plug 10 under test. The high voltage test probe 150 has a first, non-electrically conductive part 152 formed of urethane or other non-electrically conductive moldable material. This first, non-electrically conductive part 152 substantially shields an electrically conductive ring 172 described in more detail below. This first, non-electrically conductive part 152 may extend approximately three sixteenths of an inch beyond the electrically conductive ring 172, for example only. The high voltage test probe 150 also has a second part 154 which can be formed of aluminum, copper or other electrically conductive material. The second part 154 includes a raised area functioning as a probe locator 156 for insuring that the high voltage test probe 150 is in the correct position with respect to the spark plug 10 under test when placed to mechanically probe the spark plug 10. The high voltage test probe 150 includes a cavity 178 for the part of the spark plug 10 (substantially all of the spark plug 10 extending from the internal combustion engine 40) to be surrounded by the high voltage test probe 150. For the high voltage test probe 150 to electrically connect to the high voltage control box 110, a high voltage test probe wire pigtail 158 connects through the second part 154 of the high voltage test probe 150. The high voltage test probe wire pigtail 158 includes a high voltage test probe electrical connector 160 with a high voltage test probe first contact 162 and a high voltage test probe second contact 166.

As shown in FIGS. 1, 2 and 3, the high voltage test probe first contact 162 electrically connects to a high voltage test probe first wire 164 which electrically connects inside the high voltage test probe 150 to a high voltage contactor 170 for electrically connecting to the terminal end 12 of the spark plug 10. The high voltage contactor 170 may be formed of brass, stainless steel or other suitable conductive material and is electrically isolated from the second part 154 of the high voltage test probe 150. The high voltage test probe first wire 164 and the high voltage test probe second wire 168 may be rated for 40 kilovolts or other ratings as appropriate for the test voltages applied. The high voltage test probe second contact 166 electrically connects to a high voltage test probe second wire 168 which electrically connects to the electrically conductive ring 172. The electrically conductive ring 172 is formed of a conductive metal and may, for illustrative example only, be 0.88 mm in thickness. The electrically conductive ring 172 has a generally cylindrical shape with a thickness sufficient to maintain its structure and to fit as close to the insulator 14 as possible without directly contacting the spark plug 10 under test. Thus the cavity 178 in the high voltage test probe 150 has a slightly but sufficiently larger radius than the largest outer radius of the insulator 14 which fits within the high voltage test probe 150. As shown in FIG. 3, the electrically conductive ring 172 extends substantially over the insulator 14 of the spark plug 10 except for a first gap 176 and a second gap 174. The first gap 176 extends between a first end 171 of the electrically conductive ring 172 and the base 18 and is sufficient to prevent arcing to the base 18 of the spark plug 10. The second gap 174 extends between a second end 173 of the electrically conductive ring 172 and the terminal end 12 and is sufficient to prevent arcing to the terminal end 12 of the spark plug 10. These gaps 174 and 176 may, for example only, be approximately one quarter inch in length. The probe locator 156 helps insure that the electrically conductive ring 172 does not contact the spark plug 10 and that the first gap 176 and the second gap 174 are located sufficient to prevent arcing to the base 18 and the terminal end 12, respectively. Although FIGS. 1, 2 and 3 show the high voltage test probe wire pigtail 158 ending in a high voltage test probe electrical connector 160 configured as an electrical plug, the high voltage test probe first and second wires 164 and 168, respectively, may be a hardwired electrical connector 160 between the high voltage test probe 150 and the high voltage control box 110 if desired. Alternatively, the high voltage test probe first wire 164 and the high voltage test probe second wire 168 may have separate electrical connectors instead of one high voltage test probe electrical connector 160 as shown. Each separate electrical connector and first wire 164 or second wire 168 will include a high voltage test probe first contact 162 or high voltage test probe second contact 166, respectively.

Next, in FIG. 1, the high voltage control box 110 for providing the tests of the spark plug 10 is described. In conjunction with the high voltage test probe 150, the high voltage control box 110 comprises electrical circuitry and components for performing at least one and up to three tests on the spark plug 10 in accordance with the present invention. An insulator crack detection test detects whether there is a crack or other defect in the insulator 14 of the spark plug 10, as a crack 13 or other defect may lead to later failure of the spark plug 10. A spark plug firing test checks whether the spark plug 10 is firing (functional) and also generates a spark plug firing signal. The spark plug firing signal is used to indicate whether the spark plug gap 30 is within the accepted specification limits. Throughout this description, the terms "the spark plug gap is within specification" mean that the spark plug gap 30 is within acceptable dimensional tolerances as selected for a specific application.

Still referring to FIG. 1, the high voltage control box 110 electrically connects to the high voltage test probe 150 through a high voltage control box electrical connector 120. The high voltage control box electrical connector 120 has a high voltage control box first contact 122 electrically connected to a high voltage control box first wire 124 and a high voltage control box second contact 126 electrically connected to a high voltage control box second wire 128. The high voltage control box 110 also includes a high voltage source 130, which may be an ignition coil such as a standard dual ended automotive ignition coil, generally available at automotive parts stores. A first contact 132 of the high voltage source 130 electrically connects to the high voltage control box second wire 128. A second contact 134 of the high voltage source 130 electrically connects to a first contact 136 of a current shunt resistor 138. The other contact of the current shunt resistor 138 electrically connects to the high voltage control box electrical ground 140 which is the electrical ground of the circuits. The current shunt resistor 138 may be a one hundred ohm, high voltage resistor with a tolerance of one percent or less, for example only, and is used to generate a spark plug firing signal 192 (used for the spark plug gap check), using signal lines 137 and 139 respectively, as inputs into the computer 190 connected to the high voltage control box 110. Thus, the spark plug firing signal 192 is a current measurement that indicates whether the spark plug gap 30 is within specification.

Still referring to FIG. 1, a high voltage spark gap element 148, which is commercially available, connects between the first contact 132 of the high voltage source 130 and the second contact 134 of the high voltage source 130. The high voltage spark gap element 148 prevents voltage in a spark plug firing circuit 180 and an insulator crack detection circuit 182 from exceeding ten kilovolts, for example only, and is included as a safety device as recognized by those skilled in the art. Next, a voltage divider 141 includes two resistors 142 and 146 with the resistor 142 electrically connecting between the first contact 132 of the high voltage source 130 and a first contact 144 of the resistor 146. The second contact of the resistor 146 is tied to the high voltage control box electrical ground 140. Voltage divider 141 resistors 142 and 146 may be one mega ohm and one hundred ohm resistors respectively, for example only, and may provide a ten kilovolt drop across resistor 142. The voltage across the resistor 146 is used to generate an insulator crack detection signal 194, using signal lines 145 and 147 respectively, as signals into the computer 190. Next, the two high voltage relays 112 and 116, which are commercially available and may handle ten kilovolts, for example only, are connected as described. The high voltage relay 112 is connected between the first contact 132 of the high voltage source 130 and a high voltage control box circuit contact 114. The high voltage relay 116 is connected between the high voltage control box circuit contact 114 and the high voltage control box electrical ground 140. The high voltage control box 110 may include the insulator crack detection circuit 182 for generating the insulator crack detection signal 194. Additionally, the high voltage control box 110 may include the spark plug firing circuit 180 generating a spark plug firing signal 192 for indicating if the spark plug gap 30 is within specification.

Referring to FIG. 1, when the apparatus 100 is performing at least one of the three tests in accordance with the present invention, the insulator crack detection circuit 182 and the spark plug firing circuit 180 provide circuit paths through the above listed components as described. The spark plug firing circuit 180 electrically connects the high voltage contactor 170 to the high voltage source 130 to fire the spark plug 10 in a firing test and to generate a spark plug firing signal 192 indicating the spark plug gap 30 in a spark plug gap test. Since the high voltage relay 112 is closed and the high voltage relay 116 is open, current flows from the high voltage source 130 through the high voltage relay 112 and to the high voltage contactor 170. The high voltage contactor 170 is electrically connected to the terminal end 12 of the spark plug 10. The center electrode 16 of the spark plug is electrically connected to the terminal end 12 so the center electrode 16 has the potential of the high voltage source 130. The side electrode 22 of the spark plug 10 is electrically connected to the electrical ground 48 as it is assembled in the internal combustion engine 40 which is grounded. If the spark plug 10 is functioning correctly, the potential of the high voltage source 130 on the center electrode 16 will arc to the grounded side electrode 22, "firing" the spark plug 10 in a firing test. This firing generates a voltage drop across the current shunt resistor 138 which will send a spark plug firing signal 192 over signal lines 137 and 139 (connected at each end of the current shunt resistor 138) indicating the spark plug gap 30 in the spark gap test is within specification in the computer 190.

Still referring to FIG. 1, the insulator crack detection circuit 182 electrically connects the high voltage contactor 170 to the electrical ground 140 of the high voltage test box 110 since the high voltage relay 116 is closed and the high voltage relay 112 is opened. The high voltage contactor 170 is electrically connected to the terminal end 12 of the spark plug 10. The center electrode 16 of the spark plug is electrically connected to the terminal end 12 so the center electrode 16 is grounded. The electrically conductive ring 172 is electrically connected to the high voltage source 130. The non-electrically conductive part 152 of the high voltage test probe 150 substantially shields the electrically conductive ring 172 (which is at the potential of the high voltage source 130) so that it will not be inadvertently shorted or otherwise exposed. If the insulator 14 has a crack 13, the potential of the high voltage source 130 on the electrically conductive ring 172 will arc through the crack in the insulator 14 to the grounded center electrode 16. The voltage drop across the resistor 146 generates an insulator crack detection signal 194 over signal lines 145 and 147 (connected at each end of the resistor 146) indicating whether a crack 13 has been detected in the insulator crack detection test in the computer 190. The crack 13 tends to extend in a direction from the terminal end 12 of the spark plug 10 to the end 17 of the center electrode 16 in the combustion chamber 46, so even if all or part of the crack 13 is not within the electrically conductive ring 172 but is near, for example only, within one eighth of an inch of the electrically conductive ring 172, the insulator crack detection test should still detect the crack 13.

Figure 5:
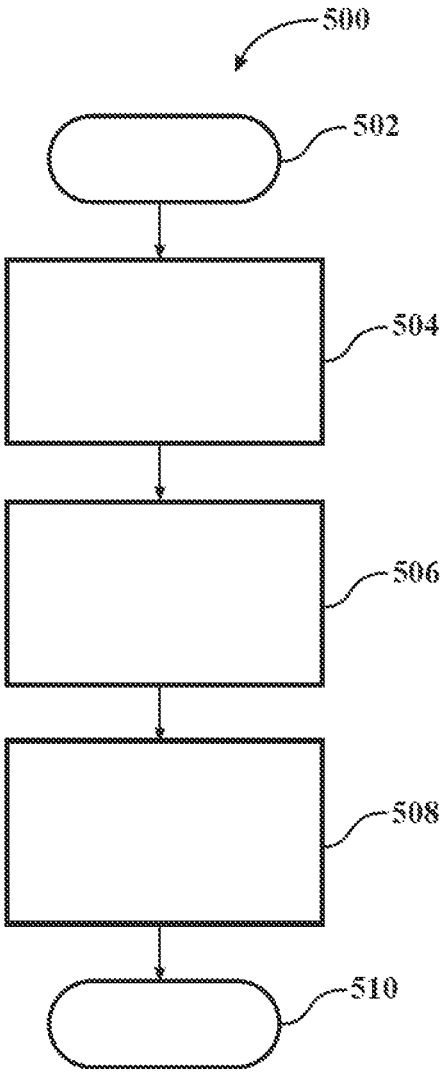
FIG. 5 is a flowchart of an embodiment of the method for testing a spark plug according to the present invention.

Referring to FIG. 5, a flowchart of an embodiment of the method 500 of the present invention is shown beginning in step 502 where the method 500 starts. The method 500 is for testing a spark plug 10, as shown in FIG. 1, after the spark plug 10 has been assembled in an internal combustion engine 40. The spark plug 10 is conventional and has the center electrode 16 surrounded by the insulator 14 and electrically connected to the terminal end 12. The spark plug 10 also has the side electrode 22 which is electrically connectable to the electrical ground 48. The center electrode 16 and the side electrode 22 are configured to form the spark plug gap 30.

Referring again to FIG. 5, the method 500 proceeds to step 504 which includes placing the high voltage test probe 150 over the part of the spark plug 10 extending from the internal combustion engine 40 (over substantially all of the spark plug 10 extending from the internal combustion engine 40) to mechanically probe the spark plug 10. This placement may be manual or automatic, such as in a test fixture. Continuing to step 506, an insulator crack detection circuit 182 in the high voltage control box 110 is connected to the high voltage test probe 150. The insulator crack detection circuit 182 electrically connects the high voltage contactor 170 to the electrical ground 140. The electrically conductive ring 172 remains connected to the high voltage source 130. The insulator crack detection circuit 182 thereby generates an insulator crack detection signal 194 indicating if the insulator 14 is cracked. The voltage is read across the resistor 146 using signal lines 145 and 147 into the computer 190. If no arcing is detected, an insulator crack detection signal 194 as shown in FIG. 1 is measured in the computer 190 determining that no crack 13 is detected. If arcing is detected between the highly charged electrically conductive ring 172 and the grounded center electrode 16, then the insulator crack detection signal 194 will have a smaller peak which will be determined in the computer 190, and the spark plug 10 will be determined to be defective. Specific values for whether the insulator crack detection signal 194 is indicated as acceptable or as defective (having a smaller peak) may be determined during test setup or calibration as is known in the art.

Still referring to FIG. 5 and continuing to step 508, a spark plug firing circuit 180 in the high voltage control box 110 is connected to the high voltage test probe 150. The spark plug firing circuit 180 electrically connects the high voltage contactor 170 to the high voltage source 130. The spark plug firing circuit 180 thereby fires the spark plug 10 and generates a spark plug firing signal 192 indicating the spark plug gap 30. A high voltage spike (for example, 10 kvolts) pulses through the spark plug 10 since the high voltage relay 112 is closed and the high voltage relay 116 is opened. In this spark plug firing circuit 180, the pulse causes a high voltage from the high voltage source 130 to be applied to the center electrode 16, and the spark plug firing circuit 180 also has the spark plug 10 side electrode 22 grounded. If the spark plug 10 is operating correctly, the spike may be only 3 kvolts, for example. To generate a spark plug firing signal 192, a current flows through the current shunt resistor 138 and makes a spark plug firing signal 192 having a generally sawtooth shape as shown in FIG. 1. The slope of the spark plug firing signal 192 changes with the size of the gap. (Another way to determine the size of the gap is to measure the width of the spark plug firing signal 192 which will get wider as the slope gets less.) Typical gaps may be nominally about 1.025 millimeters (0.95 to 1.1 millimeters with acceptable tolerances). The computer 190 determines and records if, according to the spark plug firing signal 192, the spark plug fires and if the spark plug gap 30 is within specification. As discussed above, the terms "the spark plug gap is within specification" mean that the spark plug gap 30 is within acceptable dimensional tolerances as selected for a specific application. Otherwise the spark plug 10 is determined to be defective. Specific values for whether the spark plug firing signal 192 is indicated as acceptable or as defective (having a non-sawtooth shape or a smaller slope) may be determined during test setup or calibration as is known in the art. Finally, the method 500 ends in step 510. (Either step 506 or step 508 or both may be included in the method of the present invention.)

Referring again to FIG. 1, the computer 190 may generally include a microprocessor or central processing unit, read only memory (ROM), random access memory (RAM), electrically programmable read only memory (EPROM), high speed clock, analog to digital (A/D) and digital to analog (D/A) circuitry, and input/output circuitry and devices (I/O), as well as appropriate signal conditioning and buffer circuitry. The computer 190 may include many algorithms, including testing method algorithm 500 (see FIG. 5) in accordance with the invention as described, which can be stored in ROM and executed to provide the respective functionality. Alternatively, the computer 190 may be a very basic control device for operating the high voltage control box tests and storing or sending the data as desired, or a control device having an intermediate level of processing and data storage features as is also known. Although not specifically shown in the Figures, the computer 190 may communicate wirelessly, through a communication bus, or other known means to devices, circuit elements, components, etc. as desired.

Although a conventional spark plug is described as the part under test, special spark plug designs can be tested in accordance with the present invention. For example, the insulator may be formed of material other than ceramic as long as it is suitable for spark plug requirements in the engine environment. Although specific electrical circuitry and components for performing three tests elements are listed in describing the insulator crack detection circuit and the spark plug firing circuit, one skilled in the art will appreciate that alternative components and connections may be used within the scope of the present invention. Additionally, one skilled in the art will appreciate that the circuits may be connected to the high voltage test probe in any desired order and may be included with other desired circuits for testing other components within the scope of the present invention.

While the best modes for carrying out the invention have been described in detail, those familiar with the art to which this invention relates will recognize various alternative designs and embodiments for practicing the invention within the scope of the appended claims.

The invention claimed is:

1. An apparatus for testing a spark plug after the spark plug is assembled in an internal combustion engine wherein the spark plug has a center electrode surrounded by an insulator and electrically connected to a terminal end, and a side electrode electrically connectable to an electrical ground and configured to form a spark plug gap between the center electrode and the side electrode, the apparatus comprising:

a high voltage test probe to mechanically probe the spark plug and having a non-electrically conductive part, an electrically conductive ring substantially shielded by the non-electrically conductive part, and a high voltage contactor for electrically connecting to the terminal end of the spark plug; and a high voltage control box having a high voltage source and an electrical ground and including at least one of:

an insulator crack detection circuit for connecting the high voltage contactor to the electrical ground and the electrically conductive ring to the high voltage source to generate an insulator crack detection signal indicating if an insulator is cracked, and a spark plug firing circuit for connecting the high voltage contactor to the high voltage source to fire the spark plug in a firing test and to generate a spark plug firing signal indicating if the spark plug gap is within specification.

2. The apparatus of claim 1 wherein the high voltage source is an ignition coil.

3. The apparatus of claim 1 wherein the spark plug has a base and wherein the electrically conductive ring extends substantially over the insulator while forming a first gap between the electrically conductive ring and the base sufficient to prevent arcing to the base and a second gap between the electrically conductive ring and the terminal end sufficient to prevent arcing to the terminal end.

4. The apparatus of claim 1 wherein the high voltage test probe non-electrically conductive part is formed of urethane.

5. A method for testing a spark plug after the spark plug is assembled in an internal combustion engine wherein the spark plug has a center electrode surrounded by an insulator and electrically connected to a terminal end, a side electrode electrically connectable to an electrical ground and configured to form a spark plug gap between the center electrode and the side electrode, the method comprising:

placing a high voltage test probe over substantially all of the spark plug extending from the internal combustion engine to mechanically probe the spark plug, wherein the high voltage test probe has a non-electrically conductive part, an electrically conductive ring substantially shielded by the non-electrically conductive part, and a high voltage contactor for electrically connecting to the terminal end of the spark plug; and at least one of:

connecting the high voltage contactor and the electrically conductive ring to a high voltage control box so that an insulator crack detection circuit in the high voltage control box connects the high voltage contactor to an electrical ground and the electrically conductive ring to a high voltage source thereby generating an insulator crack detection signal indicating if an insulator is cracked; and connecting the high voltage contactor to the high voltage control box so that a spark plug firing circuit in the high voltage control box connects the high voltage contactor to the high voltage source thereby generating a spark plug firing signal indicating if the spark plug gap is within specification.

6. The method of claim 5 further including the high voltage source is an ignition coil.

7. The method of claim 5 wherein the spark plug has a base and wherein the electrically conductive ring extends substantially over the insulator while forming a first gap between the electrically conductive ring and the base sufficient to prevent arcing to the base and a second gap between the electrically conductive ring and the terminal end sufficient to prevent arcing to the terminal end.

8. The method of claim 5 wherein the high voltage test probe non-electrically conductive part is formed of urethane.

9. An apparatus for testing a spark plug after the spark plug is assembled in an internal combustion engine, wherein the spark plug has a center electrode surrounded by an insulator and electrically connected to a terminal end, and a side electrode electrically connectable to an electrical ground and configured to form a spark plug gap between the center electrode and the side electrode, the apparatus comprising:

a high voltage test probe to mechanically probe the spark plug and having a non-electrically conductive part, an electrically conductive ring substantially shielded by the non-electrically conductive part, and a high voltage contactor electrically connected to the terminal end of the spark plug;

a high voltage control box having a high voltage source and an electrical ground;

an insulator crack detection circuit connecting the high voltage contactor to the electrical ground and the electrically conductive ring to the high voltage source when detecting if an insulator is cracked; and a spark plug firing circuit connecting the high voltage contactor to the high voltage source to fire the spark plug in a firing test when detecting if the spark plug gap is within specification.

10. The apparatus of claim 9 wherein the high voltage test probe is placed over the spark plug when the spark plug extends from the internal combustion engine such that the electrically conductive ring surrounds a portion of the insulator without contacting the spark plug.

11. The apparatus of claim 9 wherein the electrically conductive ring overlaps the insulator except for a first gap and a second gap, with the first gap being between a first end of the electrically conductive ring and a base of the spark plug to sufficiently prevent arcing therebetween and the second gap being between a second end of the electrically conductive ring and the terminal end of the spark plug to sufficiently prevent arcing therebetween.

12. The apparatus of claim 9 wherein the high voltage test probe includes a probe locator to position the electrically conductive ring spaced from the insulator.

13. The apparatus of claim 9 wherein a drop in voltage across a resistor occurs when a potential of the high voltage source on the electrically conductive ring arcs through the insulator to the center electrode.

14. The apparatus of claim 9 further including a voltage divider including a first resistor and a second resistor, with the first resistor electrically connecting between a first contact of the high voltage source and a first contact of the second resistor, and a second contact of the second resistor is connected to the electrical ground.

15. The apparatus of claim 1 wherein the electrically conductive ring surrounds a portion of the insulator without contacting the spark plug.

16. The apparatus of claim 1 wherein the electrically conductive ring overlaps the insulator except for a first gap and a second gap, with the first gap being between a first end of the electrically conductive ring and a base of the spark plug and the second gap being between a second end of the electrically conductive ring and the terminal end of the spark plug.

* * * * *